US012653300B2

(12) United States Patent
Zhan

(10) Patent No.: US 12,653,300 B2
(45) Date of Patent: Jun. 16, 2026

(54) ELECTRIC CLEANING DEVICE

(71) Applicant: Dongguan Selerwin Innovation Technology Co., Ltd., Dongguan (CN)

(72) Inventor: MeiJin Zhan, Dongguan (CN)

(73) Assignee: MeiJin Zhan, Dongguan (CN)

( * ) Notice: Subject to any disclaimer, the term of this patent is extended or adjusted under 35 U.S.C. 154(b) by 331 days.

(21) Appl. No.: 18/428,365

(22) Filed: Jan. 31, 2024

(65) Prior Publication Data

US 2025/0176704 A1 Jun. 5, 2025

(30) Foreign Application Priority Data

Dec. 1, 2023 (CN) ..... 202323292084.4

(51) Int. Cl.
*A46B 13/02* (2006.01)

(52) U.S. Cl.
CPC ..... *A46B 13/02* (2013.01); *A46B 2200/30* (2013.01)

(58) Field of Classification Search
CPC ..... A46B 13/02; A46B 2200/30; A47L 17/00
See application file for complete search history.

(56) References Cited

U.S. PATENT DOCUMENTS

| | | | |
|---|---|---|---|
| 2021/0077237 | A1 | 3/2021 | Zhou |
| 2021/0315673 | A1 | 10/2021 | Zhou |
| 2023/0000242 | A1 | 1/2023 | Opteka |
| 2023/0263294 | A1 | 8/2023 | Alatsaris |
| 2023/0380582 | A1 | 11/2023 | Fischer et al. |

FOREIGN PATENT DOCUMENTS

CN 213962233 U * 8/2021

* cited by examiner

*Primary Examiner* — Shay Karls

(57) ABSTRACT

An electric cleaning device includes a handle assembly, a cleaning head, and a driving assembly; the handle assembly is provided with a mounting chamber for mounting the driving assembly; the driving assembly includes a base, a guiding cylinder, a motor, a driving shaft, a telescopic sleeve, a toggle piece, and a connector; the motor and the guiding cylinder are respectively fixed on both ends of the base; the driving shaft is connected with the motor and extends into the guiding cylinder; the telescopic sleeve is axially slidably sheathed on the driving shaft, and the telescopic sleeve extends out of the guiding sleeve; a left and right spiral groove are provided on the telescopic sleeve; two ends of the left and right spiral groove are connected to form a turning portion; the toggle piece is disposed at the guiding cylinder and extends into the left or right spiral groove.

10 Claims, 5 Drawing Sheets

ELECTRIC CLEANING DEVICE

FIELD OF THE INVENTION

The present disclosure relates to the technical field of cleaning brushes. More particularly an electric cleaning device

BACKGROUND OF THE INVENTION

Currently, many customers usually use electric cleaning devices to achieve an automotive clean effect, for example, electric toothbrushes, cleaning brushes, facial cleaners, etc. For facial cleaners, it mainly includes a brush vibrating type cleaning device and a brush rotating type cleaning device. The cleaning brush generally uses a rotating brush or a manual brush. For an electric toothbrush, a linkage structure is generally used to drive the brush head to move back and forth, or a vibrating manner is used to make the brush head vibrate.

For example, the Chinese patent CN210353688U discloses a magnetic-attraction type cleaning brush head and a face cleaner and specifically discloses that the face cleaner comprises a core assembly and the described magnetic-attraction type cleaning brush head provided on the core assembly. The core assembly comprises a base, a motor, and a gear assembly which are arranged in the base, an output shaft is rotatably arranged on the base, and the motor drives the output shaft to rotate via the gear assembly. The technical solution disclosed in the patent uses on a motor to drive a brush head to rotate. However, in the rotating process of the brush head, the linear velocities at different positions of the brush head are different, and the closer to the rotational axis, the smaller the linear velocity is; therefore, when facial skin is cleaned by the rotation of the brush head, the problem of uneven cleaning force exists, resulting in inconsistent cleaning degrees.

For another example, Chinese patent CN21987807U discloses a facial cleaner, which includes a housing, an acoustic wave motor, an ultrasonic transducer, a fixing frame, and a brush head. The acoustic wave motor is fixedly connected to the fixing frame, the ultrasonic transducer is arranged on the fixing frame in a threaded manner, and the brush head is detachably arranged on the fixing frame, the acoustic wave motor drives the brush head to swing back and forth so as to clean a face. By arranging the acoustic wave motor and the rubber brush head at the head part of the facial cleaner, the brush head can swing back and forth under the drive of the acoustic wave motor, and at the same time, a slight vibration can be generated to form back and forth wiping on the face part. When the skin is cleaned using the brush head vibration, since the brush displacement amplitude is small due to the vibration, the cleaning efficiency will be reduced.

SUMMARY OF THE INVENTION

The object of the present disclosure is to provide an electric cleaning device, the cleaning head can be moved back and forth in a straight line to ensure the linear speed at each position of the cleaning head is consistent, the problem of poor cleaning is avoided, and the cleaning head is used for reciprocating cleaning, thus, the cleaning range can be increased, and the cleaning efficiency can be increased.

To achieve the above object, the present disclosure provides an electric cleaning device, which includes a handle assembly, a cleaning head, and a driving assembly. The handle assembly is provided with a mounting chamber, where the driving assembly is mounted.

The driving assembly includes a base, a guiding cylinder with a port end, a motor, a driving shaft, a telescopic sleeve with a first end and a second end, a toggle piece, and a connector. The motor and the guiding cylinder are respectively fixed on both ends of the base. The driving shaft is connected to the shaft of the motor and extends into the guiding cylinder. The telescopic sleeve is axially slidably sheathed on the driving shaft, and the first end of the telescopic sleeve extends out of the port end of the guiding sleeve. A left spiral groove and a right spiral groove are provided on the outer wall of the telescopic sleeve, and the left spiral groove and the right spiral groove extend from the first end of the telescopic sleeve to the second end thereof. Two ends of the left spiral groove and the right spiral groove are connected to form a turning portion. The toggle piece is disposed at the port end of the guiding cylinder and extends into the left spiral groove or the right spiral groove. The first end of the telescopic sleeve is rotatably connected to the connector, and the connector is slidably connected to the guiding sleeve or the handler assembly. The cleaning head is provided on the connector.

Further, the turning portion is concave.

Further, the toggle piece includes a connecting portion and a toggle portion, the connecting portion is rotatably connected to the guiding sleeve, and the toggle portion is located at one end of the connecting portion, which is turned back and forth between the left spiral groove and the right spiral groove.

Further, the toggle portion is an arc plate with a radian is less than 180°; the upper and lower side faces of the two ends of the toggle portion are provided with avoiding inclined faces.

Further, the driving shaft is also tightly sheathed with a spline; a spline groove is provided in the telescopic sleeve, and the spline is connected to the spline groove in a sliding fit manner.

Further, a cavity is provided in the base, and a decelerator is further provided in the cavity; the decelerator includes a driving gear, a duplex gear, and a driven gear; the drive gear is provided on a shaft of the motor, the driven gear is provided on a bottom end of the driving shaft, the duplex gear is rotatably connected in the base, and meshed with the driving gear and the driven gear, respectively.

Further, the outer wall of the guiding cylinder is provided with a plurality of guiding slots; the connector has a limiting cylinder sleeved on the outer wall of the guiding sleeve, and the inner wall of the limiting cylinder is provided with a plurality of limiting members slidably fitted with the guiding slots; a counterbore is provided at the bottom of each of the guiding slots, a locking screw passes through the counterbore to be connected with the base.

Further, one end of the handle assembly is provided with a limiting sleeve, the connector has a connecting rod slidably passing through the limiting sleeve; the limiting sleeve and the connecting rod are respectively provided with a limiting surface and a fitting surface to cooperate to prevent the connecting rod from rotating with the telescopic sleeve.

Further, the cleaning head includes a brush and a mounting portion, the mounting portion is detachably connected to the connector so that the cleaning head can be replaced.

Further, a control circuit and a battery are provided inside the hand assembly.

The above one or more technical solutions of the electronic cleaning device provided in the embodiments of the present disclosure have at least one of the following technical effects:

The electrical cleaning device in the embodiment, the motor drives the driving shaft to rotate, then the driving shaft drives the telescopic sleeve to rotate and move towards the first end of the telescopic sleeve. In the process, the toggle piece is cooperated with the left spiral groove or the right spiral groove, that is: when the toggle piece is located at the turning portion where the end of the left spiral groove is connected with the end of the right spiral groove, the toggle piece can be turned from the left spiral groove into the right spiral groove, or be turned from the right spiral groove into the left spiral groove. Simultaneously the toggle piece pushes the telescopic sleeve in reverse to move toward its second end, thereby achieving reciprocating extension and retraction of the telescopic sleeve and driving the connecting piece connected to the telescopic sleeve to move back and forth, thereby allowing the cleaning head to move back and forth. Thus, the linear speed at each position of the cleaning head is consistent, the problem of poor cleaning is avoided, and the cleaning head is used for reciprocating cleaning, thus, the cleaning range can be increased, and the cleaning efficiency can be increased.

BRIEF DESCRIPTION OF THE DRAWINGS

In order to explain more clearly the technical scheme in the embodiments of the disclosure, a brief introduction is given below to the attached drawings needed in the embodiments or the prior art description. Obviously, the attached drawings in the following description are only some embodiments of the disclosure. For ordinary technicians in this field, other drawings can be obtained according to these drawings without paying creative labor.

FIG. 1 shows a facial cleaner.

FIG. 7 shows an electric toothbrush.

EMBODIMENTS

Figure 1:
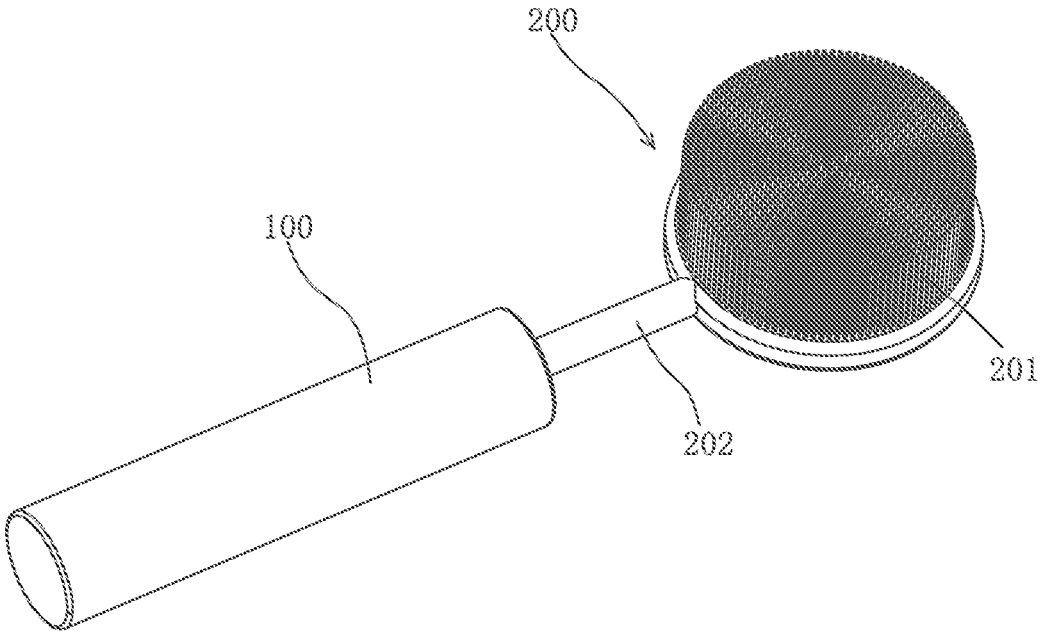
FIG. 1 is a perspective view of the electric cleaning device according to an embodiment in the present disclosure.
Figure 2:
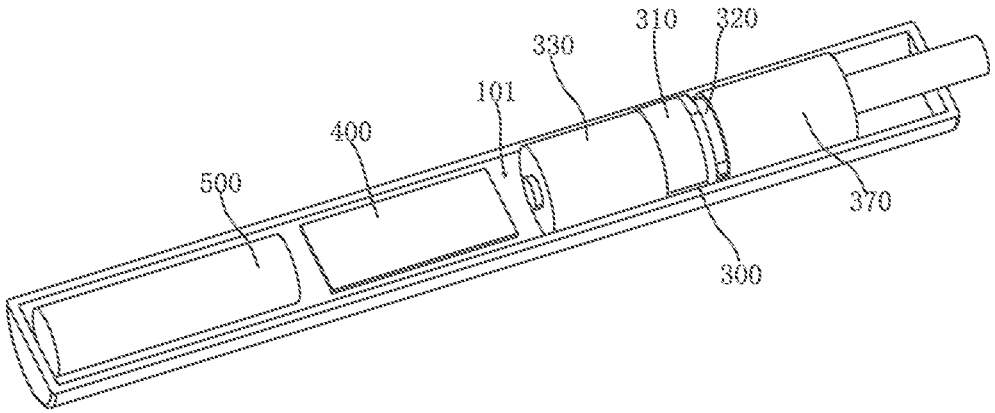
FIG. 2 is a perspective view of the handle assembly of the electric cleaning device according to an embodiment in the present disclosure.

Embodiments of the present disclosure are described in detail below, and examples of the embodiments are shown in the attached drawings, in which the same or similar labels represent the same or similar elements or elements with the same or similar function. The embodiments described below by reference to the attached drawings are exemplary and are intended to explain embodiments of the present disclosure and cannot be understood as limits in the present disclosure.

In the description of the embodiments of the present disclosure, it should be understood that the directional indications involved in the embodiments, such as the "length", "width", "upper", "lower", "left", "right", "front", "rear", "internal" and "external", indicating orientation or location relationship, are based on the orientation or position relationship showed in the figures. These directional indications are only for describing the embodiments in the present disclosure and simplifying the description, rather than indicating or implying that the device or the element must be constructed and operated in a specified azimuth, which cannot be understood as a limitation of the present disclosure.

Further, the terms "first", and "second" are used only for description purposes, and cannot be understood as indicating or implying relative importance or implicitly indicating the number of technical features indicated. Thus, features defining "first" and "second" may expressly or implicitly include one or more of the features. In the description of the embodiments of the present disclosure, the "plurality of" means two or more unless otherwise specifically limited.

In the embodiment of the disclosure, unless other specified and qualified, the terms "installation", "connection", "fixed" and other terms shall be broadly understood, for example, it may be fixed connection, detachable connection, or integration; it may be a mechanical connection or an electrical connection; it may be directly connected or indirectly connected by intermediate media, it may be an internal connection of two components or the interaction of two components. For ordinary technicians in the field, the specific meaning of the above term in the embodiment of the disclosure can be understood according to the specific circumstances.

Referring to FIGS. 1-7, an electric cleaning device, which may be a facial cleaner, electric toothbrush, or cleaning brush, includes a handle assembly 100, a cleaning head 200, and a driving assembly 300. The handle assembly 100 is provided with a mounting chamber 101, where the driving assembly 300 is mounted. The cleaning head 200 is connected to the driving assembly 300, which drives the cleaning head 300 to move back and forth.

Figure 3:
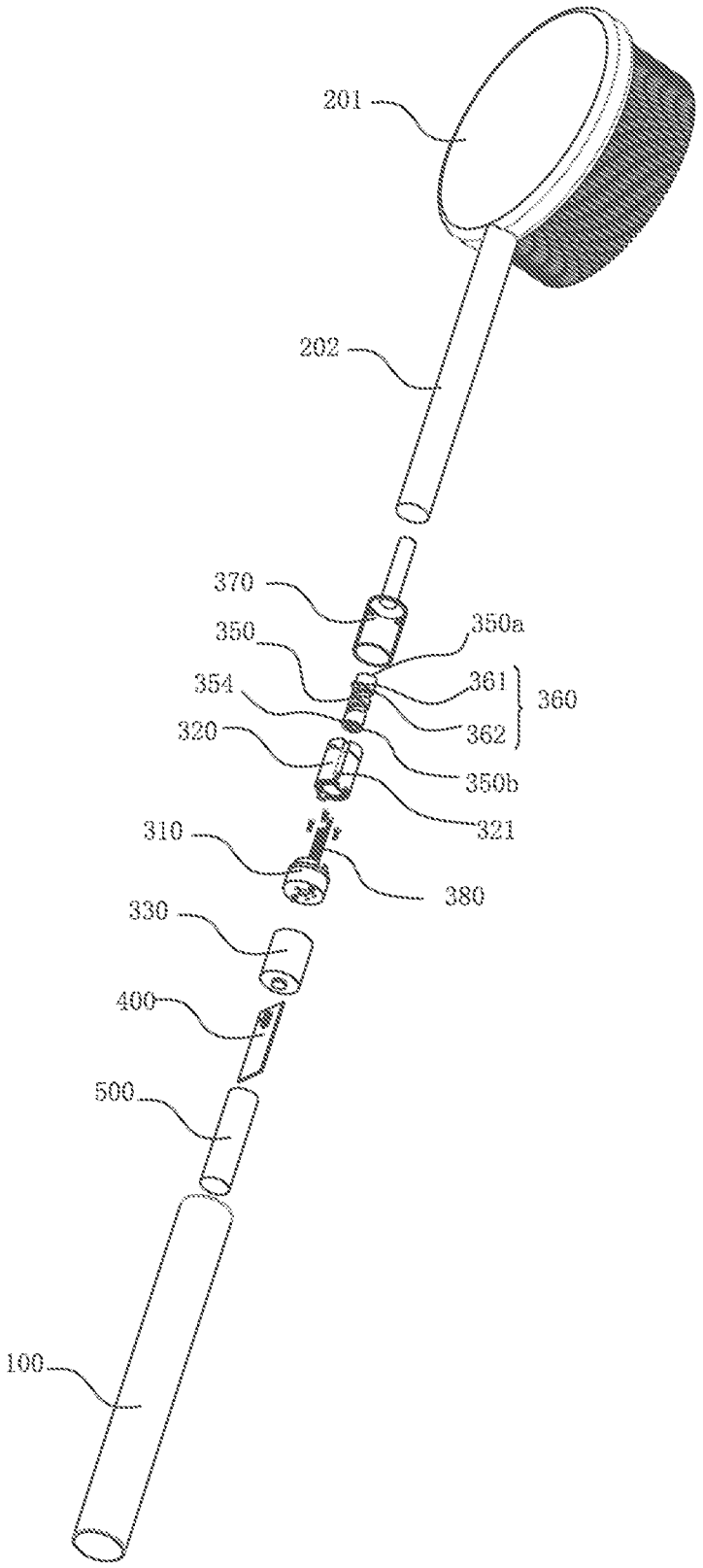
FIG. 3 is an exploded view of the electric cleaning device according to an embodiment in the present disclosure.
Figure 4:
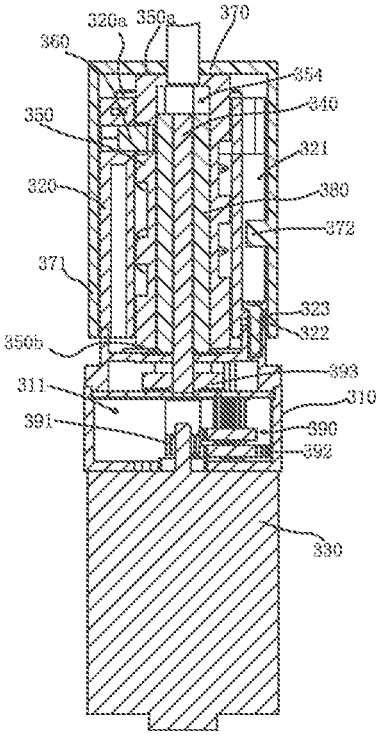
FIG. 4 is an in-section view of the electric cleaning device according to an embodiment in the present disclosure.
Figure 5:
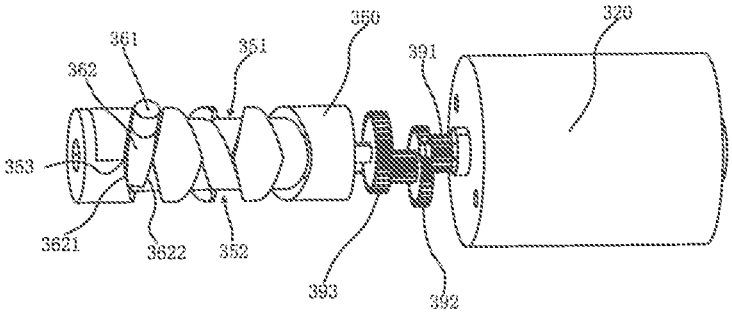
FIG. 5 is an in-section view of the motor of the electric cleaning device according to an embodiment in the present disclosure.
Figure 6:
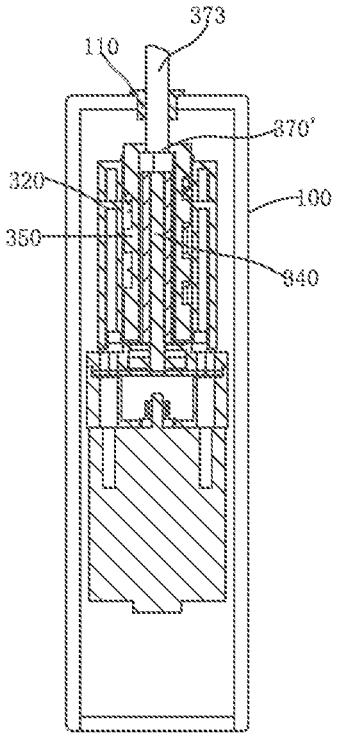
FIG. 6 is a perspective view of the electric cleaning device according to the other embodiment in the present disclosure.
Figure 7:
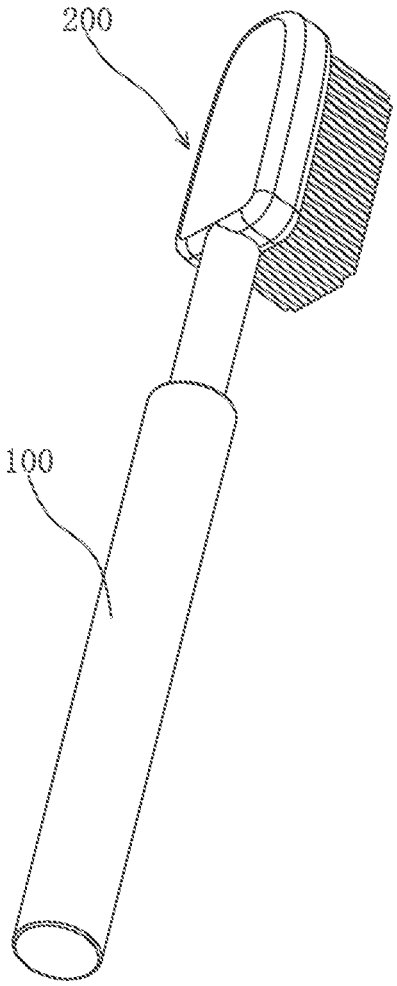
FIG. 7 is a perspective view of the electric cleaning device according to another embodiment in the present disclosure.

Referring to FIGS. 3-5, the driving assembly 300 drives the cleaning head 200 to move back and forth. Specifically, the driving assembly 300 includes a base 310, a guiding cylinder 320 with a port end 320*a*, a motor 330, a driving shaft 340, a telescopic sleeve 350 with a first end 350*a* and a second end 350*b*, a toggle piece 360, and a connector 370. The motor 330 and the guiding cylinder 320 are respectively fixed on both ends of the base 310. The driving shaft 340 is connected with the shaft of the motor 330 and extends into the guiding cylinder 320. The telescopic sleeve 350 is axially slidably sheathed on the driving shaft 340, and the first end 350*a* of the telescopic sleeve 350 extends out of the port end 320*a* of the guiding sleeve 320. A left spiral groove 351 and a right spiral groove 352 are provided on the outer wall of the telescopic sleeve 350, and the left spiral groove 351 and the right spiral groove 352 extend from the first end 350*a* of the telescopic sleeve 350 to the second end 350*b* thereof. Two ends of the left spiral groove 351 and the right spiral groove 352 are connected to form a turning portion 353. The toggle piece 360 is disposed at the port end 320*a* of the guiding cylinder 320 and extends into the left spiral groove 351 or the right spiral groove 352. The first end 350*a* of the telescopic sleeve 350 is rotatably connected to the connector 370, and the connector 370 is slidably connected to the guiding sleeve 320 or the handler assembly 100. The cleaning head 200 is provided on the connector 370.

The electrical cleaning device in the embodiment, the motor 330 drives the driving shaft 340 to rotate, then the driving shaft 340 drives the telescopic sleeve 350 to rotate and move towards the first end 350*a* of the telescopic sleeve 350. In the process, the toggle piece 360 is cooperated with the left spiral groove 351 or the right spiral groove 352, that is: when the toggle piece 360 is located at the turning portion 353 where the end of the left spiral groove 351 is connected with the end of the right spiral groove 352, the toggle piece 360 can be turned from the left spiral groove 351 into the right spiral groove 352, or be turned from the right spiral groove 352 into the left spiral groove 351. Simultaneously the toggle piece 360 pushes the telescopic sleeve 350 in reverse to move towards its second end, thereby achieving reciprocating extension and retraction of the telescopic sleeve 350, and driving the connecting piece 370 connected to the telescopic sleeve 350 to move back and forth, thereby allowing the cleaning head 200 to move back and forth. Thus, the linear speed at each position of the cleaning head 200 is consistent, the problem of poor cleaning is avoided, and the cleaning head 200 is used for reciprocating cleaning, thus, the cleaning range can be increased, and the cleaning efficiency can be increased.

Further, referring to FIG. 5, the end of the left spiral groove 351 and the end of the right spiral groove 352 are connected to form a concave, that is the turning portion 353. In the embodiment, when the toggle piece 360 is located at the turning portion 353, if the telescopic sleeve 350 continues to rotate, the toggle piece 360 will be turned from the left spiral groove 351 into the right spiral groove 352, or be turned from the right spiral groove 352 into the left spiral groove 351.

Further, referring to FIG. 5, the toggle piece 360 includes a connecting portion 361 and a toggle portion 362, the connecting portion 361 is rotatably connected to the guiding sleeve 320, and the toggle portion 362 is located at one end of the connecting portion 361, which is turned back and forth between the left spiral groove 351 and the right spiral groove 352. In the embodiment, during the rotation of the telescopic sleeve 350, the toggle portion 362 arrives at the turning portion 353 from the left spiral groove 351 or the right spiral groove 352, if the telescopic sleeve 350 continues to rotate, the turning portion 353 will push the toggle portion 362 to deflect by a certain angle, so that the toggle portion 362 is turned into the right spiral groove 352 or the left spiral groove 351, thereby achieving direction conversion.

Further, referring to FIGS. 3-5, the toggle portion 362 is an arc plate with a radian is less than 180°. The upper and lower side faces of the two ends of the toggle portion 362 are provided with avoiding inclined faces 3621 and 3622. In this embodiment, the toggle portion 362 is designed as an arc plate, which makes the cooperation between the toggle portion 362 and the spiral groove more stable.

Further, referring to FIGS. 3-4, the driving shaft 340 is also tightly sheathed with a spline 380. A spline groove 354 is provided in the telescopic sleeve 350, and the spline 380 is connected to the spline groove 354 in a sliding fit manner. In this embodiment, the driving shaft 340 drives the telescopic sleeve 350 to rotate, and at the same time, causes the telescopic sleeve 350 to stably move axially relative to the driving shaft 340.

Further, referring to FIGS. 3-4, a cavity 311 is provided in the base 310, and a decelerator 390 is further provided in the cavity 311. The decelerator 390 includes a driving gear 391, a duplex gear 392, and a driven gear 393. The drive gear 391 is provided on a main shaft of the motor 330, the driven gear 393 is provided on a bottom end of the driving shaft 340, the duplex gear 392 is rotatably connected in the base 310, and the duplex gear 392 is meshed with the driving gear 391 and the driven gear 393, respectively. In this embodiment, the motor 330 drives the driving gear 391 to rotate, and the driving gear 391 is meshed with the duplex gear 392, so that the driven gear 393 can be driven to rotate under the action of the duplex gear 392, thereby driving the driving shaft 340 to rotate. Under the action of the decelerator 390, the rotation speed of the telescopic sleeve 350 can be reduced, thereby reducing the telescopic frequency of the telescopic sleeve 350 and improving the driving force for the telescopic sleeve 350 to stretch.

Further, in an embodiment, the connector 370 can only move in a straight line. Specifically, referring to FIGS. 3-4, the outer wall of the guiding cylinder 320 is provided with a plurality of guiding slots 321. The connector 370 has a limiting cylinder 371, which is sleeved on the outer wall of the guiding sleeve 320, and the inner wall of the limiting cylinder 371 is provided with a plurality of limiting members 372 slidably fitted with the guiding slots 321. In the embodiment, due to the guiding cylinder 320 is fixed on the base 310, the guiding slots 321 on the guiding cylinder 320 are fixed, therefore, the limiting members 372 on the limiting cylinder 371 are limited by the guiding slots 321 to only move back and forth in a straight line along the guiding slots 321, but not to rotate. During the rotation and the reciprocating extension and retraction of the telescopic sleeve 350, although the telescopic sleeve 350 is rotatably connected with the connector 370, under the cooperation of the guiding slots 321 and the limiting members 372, the telescopic sleeve 350 can only drive the connector 370 to move back and forth in a straight line, but not to rotate.

Further, a counterbore 322 is provided at the bottom of each of the guiding slots 321, a locking screw 323 passes through the counterbore 322 to be connected with the base 310, thereby fixedly connecting the guiding cylinder 320 with the base 310. Due to the locking screw 323 being arranged on the bottoms of the guiding slots 321, it is necessary to use a flange to fixedly connect the guiding sleeve 320 to the base 310. The overall size of driving assembly 300 can be reduced.

Further, in the other embodiment, the connector 370 can only move in a straight line. Specifically, referring to FIG. 6, one end of the handle assembly 100 is provided with a limiting sleeve 110, the connector 370' has a connecting rod 373 slidably passing through the limiting sleeve 110. The limiting sleeve 110 and the connecting rod 373 are respectively provided with a limiting surface and a fitting surface to cooperate to prevent the connecting rod 373 from rotating with the telescopic sleeve 350. In the embodiment, the limiting sleeve 110 not only has a good guiding effect on the connecting rod 373 but also can limit the rotation of the connecting rod 373, so that the connector 370 can only move back and forth in a straight line.

Further, referring to FIG. 1, the cleaning head 200 includes a brush 201 and a mounting portion 202, the mounting portion 202 is detachably connected to the connector 370, so that the cleaning head 200 can be replaced.

Further, a control circuit 400 and a battery 500 are provided inside the hand assembly 100, The battery 500 supplies electric energy to the driving assembly 300, and the control circuit 400 controls the driving assembly 300.

The above are only preferred embodiments of the present disclosure, and are not used to limit the present disclosure. Any modification, equivalent replacement, and improvement made within the spirit and principle of the present disclosure should be included in the protection scope of the present disclosure.

The invention claimed is:

1. An electric cleaning device, comprising a handle assembly, a cleaning head, and a driving assembly; said handle assembly is provided with a mounting chamber, where said driving assembly is mounted;

wherein said driving assembly includes a base, a guiding cylinder with a port end, a motor, a driving shaft, a telescopic sleeve with a first end and a second end, a toggle piece, and a connector; said motor and said guiding cylinder are respectively fixed on both ends of said base; said driving shaft is connected with a shaft of the motor and extends into said guiding cylinder; said telescopic sleeve is axially slidably sheathed on said driving shaft, and said first end of said telescopic sleeve extends out of said port end of said guiding sleeve; a left spiral groove and a right spiral groove are provided on an outer wall of said telescopic sleeve, and said left spiral groove and said right spiral groove extend from said first end of said telescopic sleeve to said second end thereof; two ends of said left spiral groove and said right spiral groove are connected to form a turning portion; said toggle piece is disposed at said port end of said guiding cylinder and extends into said left spiral groove or said right spiral groove; said first end of said telescopic sleeve is rotatably connected to said connector, and said connector is slidably connected to said guiding sleeve or said handle assembly; said cleaning head is provided on said connector.

2. The electric cleaning device according to claim 1, wherein said turning portion is a concave.

3. The electric cleaning device according to claim 1, wherein said toggle piece includes a connecting portion and a toggle portion, said connecting portion is rotatably connected to said guiding sleeve, and said toggle portion is located at one end of said connecting portion, which is turned back and forth between said left spiral groove and said right spiral groove.

4. The electric cleaning device according to claim 3, wherein said toggle portion is an arc plate with a radian is less than 180°; an upper and lower side faces of two ends of said toggle portion are provided with avoiding inclined faces.

5. The electric cleaning device according to claim 1, wherein said driving shaft is also tightly sheathed with a spline; a spline groove is provided in said telescopic sleeve, and said spline is connected to said spline groove in a sliding fit manner.

6. The electric cleaning device according to claim 1, wherein a cavity is provided in said base, and a decelerator is further provided in said cavity; said decelerator includes a driving gear, a duplex gear, and a driven gear; said drive gear is provided on a shaft of said motor, said driven gear is provided on a bottom end of said driving shaft, said duplex gear is rotatably connected in said base, and meshed with said driving gear and said driven gear, respectively.

7. The electric cleaning device according to claim 1, wherein an outer wall of said guiding cylinder is provided with a plurality of guiding slots; said connector has a limiting cylinder sleeved on an outer wall of said guiding sleeve, and an inner wall of said limiting cylinder is provided with a plurality of limiting members slidably fitted with said guiding slots; a counterbore is provided at a bottom of each of said guiding slots, a locking screw passes through said counterbore to be connected with said base.

8. The electric cleaning device according to claim 1, wherein one end of said handle assembly is provided with a limiting sleeve, said connector has a connecting rod slidably passing through said limiting sleeve; said limiting sleeve and said connecting rod are respectively provided with a limiting surface and a fitting surface to cooperate to prevent said connecting rod from rotating with said telescopic sleeve.

9. The electric cleaning device according to claim 1, wherein said cleaning head includes a brush and a mounting portion, said mounting portion is detachably connected to said connector, so that said cleaning head can be replaced.

10. The electric cleaning device according to claim 1, wherein a control circuit and a battery are provided inside said handle assembly.

* * * * *